United States Patent [19]

Noorily

[11] Patent Number: 4,731,032

[45] Date of Patent: Mar. 15, 1988

[54] PROTECTIVE COVER FOR ELECTRICAL CONNECTOR

[75] Inventor: Peter Noorily, Bridgewater, N.J.

[73] Assignee: Thomas & Betts Corporation, Bridgewater, N.J.

[21] Appl. No.: 849,667

[22] Filed: Apr. 9, 1986

[51] Int. Cl.[4] ..... H01R 13/44

[52] U.S. Cl. ..... 439/136; 439/142; 439/148

[58] Field of Search ..... 339/36, 38, 39, 44 R, 339/44 M; 439/135, 136, 142, 144, 147, 148

[56] References Cited

U.S. PATENT DOCUMENTS

| | | | |
|---|---|---|---|
| 3,165,574 | 1/1965 | Carling | 174/59 |
| 3,167,374 | 1/1965 | Healy | 339/60 |
| 3,182,280 | 5/1965 | Daut et al. | 339/66 |
| 3,214,713 | 10/1965 | Strobel | 339/97 |
| 3,239,791 | 3/1966 | Fyrk | 339/44 |
| 3,284,563 | 11/1966 | Muschong | 174/145 |
| 3,387,252 | 6/1968 | Rothweiler | 339/38 |
| 3,423,717 | 1/1969 | Klier et al. | 339/36 |
| 3,452,321 | 6/1969 | Carissimi et al. | 339/108 |
| 3,933,409 | 1/1976 | Kloots | 350/96 |
| 3,980,372 | 9/1976 | Ranzanigo | 339/41 |
| 3,989,334 | 11/1976 | Fortino | 339/41 |
| 4,059,322 | 11/1977 | Fellner | 339/44 |
| 4,070,078 | 1/1978 | Chrones | 339/44 |
| 4,258,970 | 3/1981 | Bourdon et al. | 339/38 |
| 4,274,692 | 6/1981 | Hoffman et al. | 339/60 |
| 4,408,813 | 10/1983 | Koehler | 339/38 |
| 4,421,369 | 12/1983 | Myking | 339/36 |

FOREIGN PATENT DOCUMENTS

| | | | |
|---|---|---|---|
| 2653440 | 6/1978 | Fed. Rep. of Germany | 339/36 |
| 2742653 | 3/1979 | Fed. Rep. of Germany | 339/36 |

OTHER PUBLICATIONS

Publication (author unknown), No. GA27-3579-1, 5 pages, believed to have publication date prior to filing date of subject application.

*Primary Examiner*—Gil Weidenfeld
*Assistant Examiner*—Paula A. Austin
*Attorney, Agent, or Firm*—Robert M. Rodrick; Salvatore J. Abbruzzese

[57] ABSTRACT

A protective cover for removable attachment to the open end of an electrical connector that has exposed electrical contacts thereat, includes an insulative body having walls for substantially enclosing the open end of the electrical connector. The body includes a pair of guiding members that are adapted to engage side surface of walls of the electrical connector and guide the installation of the cover onto the connector such that potential damage to the electrical contacts will be minimized or prevented. The dust cover includes a flexible tether preferably integrally attached to the insulative body, the tether terminating in a discontinuous loop. The discontinuous loop has an opening so that the loop may be removably attached to an electrical cable that is terminated to the electrical connector. In the installed condition, the dust cover suitably prevents contaminants, debris or other particles from entering the open end of the connector while the electrical connector is in a disconnected condition.

15 Claims, 7 Drawing Figures

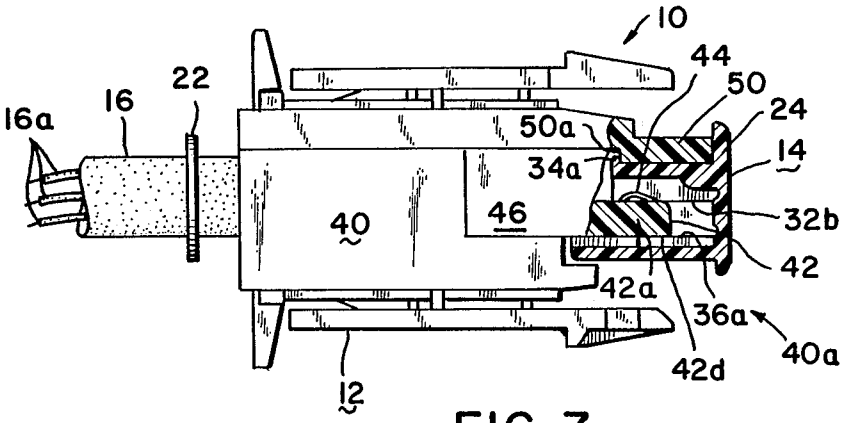
FIG. 7
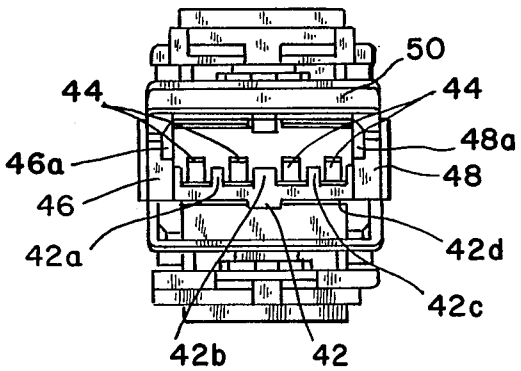
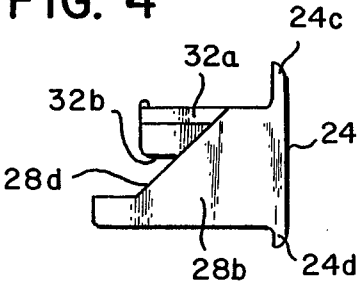
FIG. 4
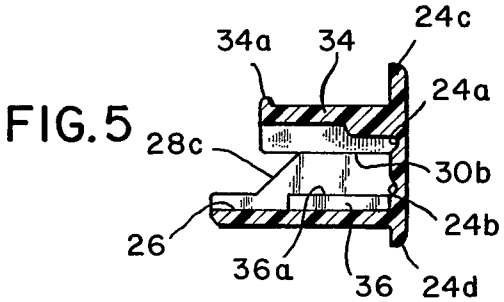
FIG. 5

PROTECTIVE COVER FOR ELECTRICAL CONNECTOR

FIELD OF THE INVENTION

This invention relates to a protective cover and in particular to such a cover that is removably attached to an electrical connector.

BACKGROUND OF THE INVENTION

In order to provide electrical power to computer terminals or the like which may be located in the middle of a floor of an office building, it is necessary to connect such terminals by an electrical cable to a main power panel or central electrical supply in the building. The electrical cables are typically terminated with an electrical plug or receptacle that is compatible and matable with a like plug or receptacle in the computer terminals. Until the terminated cable is actually connected to the computer terminals, the unmated connector at the end of the cable is often exposed and vulnerable to foreign matter such as debris, dust, powder and other contaminants. For this reason, it is desirable to provide some form of a protective cover to protect the exposed contacts of the connector while the connector is in the unmated condition.

There are a variety of known protective covers or caps that are used to protect electrical contacts in electrical connectors. One problem that occurs with some of the known connectors is the potential for damaging the contacts during the installation or application of the protective cover to the connector. Any twisting, lifting, or deforming of the contacts during installation of the dust cover can render the connector inoperable when such connector is subsequently mated with the computer terminals or the like in operation. Accordingly, it is desirable to not only provide a protective cover for the unmated ends of a connector, but also to provide such a cover that will eliminate or reduce the potential for damage to the electrical contacts during the installation or application of the cover to the connector.

SUMMARY OF THE INVENTION

It is a primary object of the present invention to provide an improved protective cover for attachment to an electrical connector.

It is another object of the present invention to provide an improved protective cover that includes guiding members for guiding the installation of such a cover onto an electrical connector at an open end of such connector having exposed electrical contacts.

In accordance with a preferred embodiment of the present invention, a cover for attachment to an open end of an electrical connector that has electrical contacts exposed thereat comprises an insulative body including a generally planar wall. Projecting outwardly from such wall is an engagement surface and a spaced contact surface. The spaced engagement surface and contact surface define an opening for receipt therein of a portion of an electrical connector at the open end thereof. The cover includes at least two spaced guiding members projecting outwardly from the wall, the guiding members each including a guiding surface for contacting spaced surfaces of the electrical connector at the open end for guiding the electrical connector portion between the engagement surface and the contact surface on the cover.

In a particularly configured form of the invention, an electrical connector that is terminated to an electrical cable is provided in combination with the improved cover. The cover is in removable attachment with the connector and the contact surface on the cover is in contact with an insulative partition that is disposed between and separating the electrical contacts on the connector and the engagement surface of the cover is engaged with an undersurface of a portion of the open end of the connector.

BRIEF DESCRIPTION OF THE DRAWING

FIG. 4 is a side elevation view of the protective cover of the invention.

FIG. 5 is a cross-sectional view of the cover as seen along viewing lines V—V of FIG. 2.

FIG. 6 is a front elevation view of the connector of FIG. 1 with the protective cover removed to show various features at the mating end of the connector.

FIG. 7 is a side elevation view of the electrical connector and protective cover combination of FIG. 1 partially sectioned to show the removable attachment of the cover to the mating end of the connector.

DETAILED DESCRIPTION OF THE PREFERRED EMBODIMENT

Figure 1:
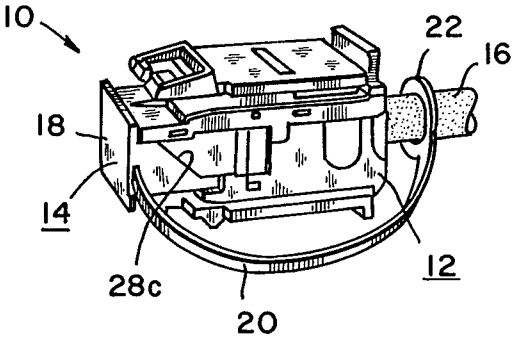
FIG. 1 is a side perspective view illustrating in accordance with the invention an electrical connector terminated to an electrical cable and a protective cover removably attached to such connector.
Figure 2:
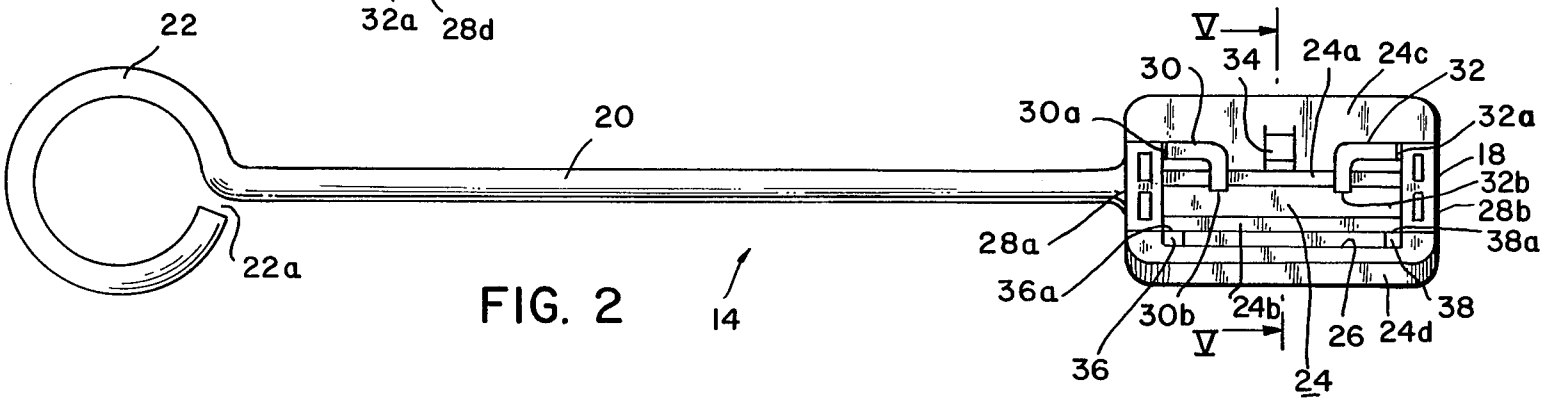
FIG. 2 is a front elevation view of the protective cover in accordance with the preferred embodiment of the invention.
Figure 3:
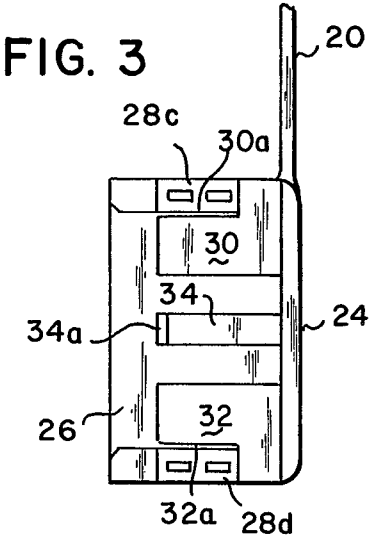
FIG. 3 is a top plane view of the cover of FIG. 2 and showing only a portion of the attached flexible tether.

Referring now to the drawing, there is shown in FIG. 1 an assembly 10 comprising an electrical connector 12 and a protective dust cover or cap 14. The electrical connector 12 as shown herein is of the type particularly useful as an electrical data connector that is terminated to an electrical cable 16. Such an electrical connector is shown and described more fully in applicant's co-pending application Ser No. 785,314, filed on Oct. 7, 1985, entitled "Electrical Connector and Latching Apparatus Therefor" and being commonly assigned with the subject application. As will be described in more detail hereinafter, the protective cover 14 comprises an insulative body 18 and a flexible tether 20 that is terminated in a discontinuous loop 22, the loop 22 being removably attached to the electrical cable 16.

Turning now to FIGS. 2–5, the details of the protective dust cover or cap 14 may be more fully understood. The protective cover 14, comprising body 18, flexible tether 20 and discontinuous loop 22 is preferably integrally formed of a plastic material such as nylon. The body 18 comprises a substantially planar back wall 24 that has a generally rectangular configuration and wherein the four corners thereof are preferably curved. Projecting outwardly from the back wall 24 and extending substantially perpendicular therewith is a bottom wall 26, bottom wall 26 also being generally planar and of generally rectangular configuration. At the spaced margins of the back wall 24 and bottom wall 26, there are a pair of opposing side walls **28*a* and 28*b* that are respectively joined to the back wall 24 and bottom wall 26. The front edges of the side walls 28*a* and 28*b* are each formed to have an inclined edge 28*c* and 28*d* respectively, the angle of incline being particularly configured to be in conformance with a portion of the front mating end of the electrical connector 12. Openings are provided in the inclined edges 28c and 28d** to facilitate the manufacturing of the cover, which is preferably formed by a conventional molding operation.

Still referring to FIGS. 2–5, a pair of guiding members, 30 and 32 project outwardly from the back wall 24. The guiding members 30, 32 are preferably formed to have an L-shaped cross-section as illustrated particularly in FIG. 2. At one end of the L-shaped leg that extends generally parallel to bottom wall 26 there are provided on each of the guiding members, a guiding surface 30a and 32a. At the end of the other leg that extends generally in a direction perpendicular to the bottom wall 26, there is provided on each of the guiding members a contact surface 30b and 32b. The guiding surfaces 30a and 32a are formed to be closer to the side walls 28a and 28b than the contact surfaces 30b and 32b. The spacing between contact surfaces 30b and 32b is formed, as will be described hereinafter to suitably engage insulative partitions on the mating end of the electrical connector 12. Contacting surfaces 30b and 32b project generally perpendicularly from the back wall 24 and extend substantially parallel to the bottom wall 26.

Disposed generally between the guiding members 30 and 32 is a deflectable arm 34, arm 34 projecting generally perpendicularly from back wall 24 and substantially parallel to bottom wall 26. At the distal free end of arm 34 there is a projecting portion 34a that serves as a latch for removable connection to the mating end of the connector 12 as will be described hereinafter. In the back wall 24 there are two recesses 24a and 24b provided therein, such recesses being formed for facilitating the molding operation in the manufacturing of the cover 14. Back wall 24 also includes an upwardly extending flange 24c and a downwardly extending flange 24d for purposes of manually grasping the cover to aid in the installation and removal of the cover to the connector 12.

Supported on the bottom wall 26 and disposed adjacent the side walls 28a and 28b are a pair of opposing steps 36 and 38. Each of the steps has on its upper surface an engagement surface 36a and 38a that project outwardly from the back wall and extend substantially parallel to the bottom wall 26. As will be described hereinafter, engagement surfaces 36a, 38a and contacting surfaces 30b and 32b define an opening for receipt of a portion of the electrical connector 12 when the cover 14 is installed thereon.

Flexible tether 20, integrally attached and projecting from the side wall 28a, is preferably made of uniform thickness throughout its entire length. Loop 22 formed at the terminal end of the flexible tether 20 is provided to be discontinuous and thereby defining an opening 22a by which the loop may be removably attached to an electrical cable 16 or the like.

Turning now to FIGS. 6 and 7, the particular details of the mating end of the electrical connector 12 and the attachment of the cover 14 thereto may be more fully understood. The electrical connector 12, which as indicated above in its preferred form is of the type shown in commonly assigned, co-pending application U.S. Ser. No. 785,314 includes an insulative housing 40 and a mating end 40a. At the mating end 40a, the electrical connector includes a ledge portion 42 projecting outwardly from a central portion thereof. Supported on ledge portion 42 are a plurality of electrical contacts 44 each being separated by an insulative partition 42a, 42b and 42c, each partition being integrally formed with the ledge portion 42. In the preferred configuration as shown for example in FIG. 6, there are four electrical contacts insulatively spaced on the ledge portion 42, it being understood that any suitable number of contacts in a particular application may be used in accordance with the invention. It should be understood that electrical contacts 44 are suitably electrically connected to electrical conductors 16a that are encapsulated in an insulative jacket of electrical cable 16.

At the marginal edges of the electrical connector housing 40, there are a pair of spaced side surfaces 46 and 48 respectively. Each of these side surfaces 46 and 48 preferably include an inwardly chamfered portion 46a and 48a serving as entrance guides for the installation of the cover 14 as will be explained. Spaced upwardly above the ledge portion 42 and the contacts 44 is a lid portion 50 that overhangs the ledge portion 42. Lid portion 50 as seen in FIG. 7, includes a shoulder portion 5Oa.

In FIG. 7, the protective cover 14 is shown in assembly with the connector 12. The contact surfaces 30b and 32b on the guiding members 30 and 32, are particularly dimensioned at a spacing to engage partitions 42a and 42c, respectively. During installation of the cover 14 to the mating end 40 of the electrical connector 12, the guiding members 30 and 32 are inserted beneath the lid portion 50 and between the housing side surfaces 46 and 48. During insertion the guiding surfaces 30a and 32a contact the chamfered entrance surfaces 46a and 48a to facilitate the insertion of the guiding members 30 and 32. As the guiding surfaces 30a and 32a strike the side surfaces of the housing 46 and 48, it is assured that the contact surfaces 30b and 32b at the bottom leg of the guiding members are suitably positioned over the insulative partitions 42a and 42c. In this manner, damage to the electrical contacts 44 during cover installation is minimized or eliminated.

During continued insertion of the cover onto the housing mating end 40a, the marginal edges of a bottom surface 42d of the ledge portion 42 makes engagement with the engagement surfaces 36a and 38a supported on the bottom wall 26 of the cover 14. As such, the ledge portion 42 is received between the contact surfaces 30b and 32b at the ledge portion upper surface and engagement surfaces 36a and 38a at the lower surface of the ledge portion 42. Insertion of the cover continues until the protruding latch portion 34a, which slides along the undersurface of lid 50 during insertion, makes engagement with lid portion shoulder 50a. The back wall 24 will then abut against the front of the lid portion 50 thereby preventing further insertion of the cover 14. In this position, as is seen also in FIG. 1, the inclined edges 28c and 28d of the cover sidewalls are disposed closely adjacent to the correspondingly formed inclined side surfaces of the housing 40. In this position, the protective cover substantially encloses the mating end 40a of the connector thereby covering the exposed contacts 44 and preventing dirt, debris or other foreign substances or contaminants from entering the mating end while the electrical connector is in a disconnected condition.

As further seen in FIGS. 1 and 7, the flexible tether 20 is manipulated so that the loop 22 is at the back end of the connector 12 whereat the discontinuous loop is suitably, removably installed around the electrical cable 16.

Having just described the preferred embodiment of the protective cover 14 and its assembly to an electrical connector herein, it can be seen that the cover provides an improvement in the art. In addition to providing for protection against contaminants or the like, the cover also includes guiding features that minimize the potential damage of the electrical contacts during installation of the cover. While other variations or modifications may be made to the preferred embodiment shown and described herein, it should be understood that such variations or modifications are within the contemplated scope of the present invention. Accordingly, the preferred embodiment shown herein is intended in an illustrative rather than in a limiting sense. The true scope of the invention is set forth in the following claims.

I claim:

1. A cover for attachment to an open end of an electrical connector having electrical contacts exposed thereat, comprising:

an insulative body including a generally planar wall and a bottom wall extending substantially perpendicular to said planar wall;

two engagement surfaces separated from each other and projecting outwardly from said planar wall and substantially parallel to said bottom wall;

two contact surfaces separated from each other and projecting outwardly from said planar wall and substantially parallel to said bottom wall, said contact surfaces being spaced from said engagement surfaces, said engagement surfaces and said contact surfaces defining an opening for receipt therein of a portion of an electrical connector at the open end thereof; and at least two spaced guiding members projecting outwardly from said planar wall, said guiding members each including a guiding surface on a respective one of said contacting surfaces for contacting spaced walls of said electrical connector at said open end for guiding said electrical connector portion between said engagement surface and said contact surface.

2. A cover according to claim 1, wherein said engagement surfaces are spaced upwardly from said bottom wall a first distance and said contact surfaces are spaced upwardly from said bottom wall a second distance greater than said first distance.

3. A cover according to claim 1, wherein said guiding members each have a generally L-shaped cross-section, the contacting surface on each guiding member being disposed at one end of a leg and the guiding surface on each guiding member being at the end of the other leg.

4. A cover according to claim 1, wherein said body includes a pair of spaced sidewalls, said sidewalls each extending between and being joined to said bottom wall and said planar wall.

5. A cover according to claim 4, wherein said guiding members are disposed between said sidewalls.

6. A cover according to claim 5, wherein said guiding surface on each guiding member is disposed closer to a respective sidewall than the contacting surface thereon.

7. A cover according to claim 4, wherein each sidewall has an inclined free edge.

8. A cover according to claim 7, further including latching means for removably securing said cover to said electrical connector.

9. A cover according to claim 8, wherein said latching means includes a deflectable arm projecting outwardly from said planar wall, extending substantially parallel to said bottom wall and having at its free distal end thereof a projection for latching to said portion of said electrical connector.

10. A cover according to claim 9, wherein said deflectable arm is disposed between said guiding members.

11. A cover according to claim 9, further including a flexible tether extending from said body, said tether terminating in a discontinuous loop defining an opening by which said loop may be removably attached to an electrical cable or the like that is terminated by said electrical connector.

12. In combination:

an electrical connector terminated to an electrical cable, said connector comprising an insulative housing having a plurality of electrical contacts, said contacts being electrically connected to conductors of said cable, said housing having a mating end including a ledge portion supporting said contacts in spaced disposition thereon and a lid portion extending over and spaced from said ledge portion, said ledge portion including on its upper surface insulative partitions disposed between said contacts, said housing further including opposing side surfaces extending between said ledge portion and said lid portion; and a cover in removable attachment with said terminated connector, said cover including a substantially planar, back wall and a bottom wall extending substantially perpendicular to said back wall, at least two spaced guiding members projecting outwardly from said back wall and each having thereon a guiding surface that contacts a respective side surface of said connector housing and guides the cover onto said mating end, said cover including on each of said guiding members a contact surface in contact with one of said insulative partitions and two spaced engagement surfaces supported by said bottom wall in engagement with an undersurface of said connector ledge portion.

13. The combination claimed in claim 12, wherein said cover further includes a deflectable latching arm projecting outwardly from said back wall, said arm being in contact with said lid portion and including a projection for latching to a shoulder on said lid portion.

14. The combination claimed in claim 13, wherein said cover includes a pair of spaced sidewalls, each having a free inclined edge.

15. The combination claimed in claim 13, wherein said cover includes a flexible tether extending therefrom, said tether terminating in a discontinuous loop that is removably attached to the electrical cable that is terminated by said electrical connector.

* * * * *